US008899423B2

(12) United States Patent
Irwin et al.

(10) Patent No.: US 8,899,423 B2
(45) Date of Patent: Dec. 2, 2014

(54) FINES SCALPING CHUTE FOR VARIABLE SLOPE VIBRATING SCREENS

(75) Inventors: Kenneth Irwin, Robins, IA (US); Christopher Reed, Center Point, IA (US)

(73) Assignee: Terex USA, LLC, Westport, CT (US)

( * ) Notice: Subject to any disclaimer, the term of this patent is extended or adjusted under 35 U.S.C. 154(b) by 15 days.

(21) Appl. No.: 13/569,878

(22) Filed: Aug. 8, 2012

(65) Prior Publication Data

US 2013/0037455 A1 Feb. 14, 2013

Related U.S. Application Data

(60) Provisional application No. 61/522,016, filed on Aug. 10, 2011.

(51) Int. Cl.
*B07B 1/28* (2006.01)
*B07B 1/46* (2006.01)

(52) U.S. Cl.
CPC .... *B07B 1/28* (2013.01); *B07B 1/46* (2013.01)
USPC ..... 209/317; 209/319

(58) Field of Classification Search
USPC ..... 209/315–317, 319
See application file for complete search history.

(56) References Cited

U.S. PATENT DOCUMENTS 5,074,435 A * 12/1991 Suverkrop et al. ..... 222/55
2008/0041984 A1 * 2/2008 Sauser et al. ..... 241/75

* cited by examiner

*Primary Examiner* — Michael McCullough
(74) *Attorney, Agent, or Firm* — Simmons Perrine Moyer Bergman, PLC

(57) ABSTRACT

A compact mobile variable angle vibrating screen with fines diverting systems configured to accommodate variable angles and still deliver material, via a plurality of partially nested fines chutes, to a fixed location despite angular adjustment of the vibrating screen. The system comprises a diverting pan attached to the underside and at a top end of a bottom screen and centrally positioned, such that fines material which quickly passes through the several decks encounters the diverting pan instead of falling directly onto a discharge conveyor.

6 Claims, 20 Drawing Sheets

FINES SCALPING CHUTE FOR VARIABLE SLOPE VIBRATING SCREENS

CROSS REFERENCE TO RELATED APPLICATIONS

This application claims the benefit of the filing date of the provisional patent application having Ser. No. 61/522,016 filed Aug. 10, 2011. This application also relates to the co-pending patent applications, filed on even date herewith:

patent application having Ser. No. 13/570,009 filed Aug. 8, 2012, SCREEN LIFT MECHANISM FOR VARIABLE SLOPE VIBRATING SCREENS by Payton Schirm and Greg Young and patent application having Ser. No. 13/570,001 filed Aug. 8, 2012, entitled PLATFORM AND LADDER INTERFACE FOR VARIABLE SLOPE VIBRATING SCREENS by Payton Schirm and patent application having Ser. No. 13/569,521 filed Aug. 8, 2012, entitled CONVEYOR JACKSHAFT FOR VARIABLE SLOPE VIBRATING SCREENS by Rex Carter and patent application having Ser. No. 13/569,726 filed Aug. 8, 2012, entitled CONVEYOR SUPPORT MECHANISM FOR VARIABLE SLOPE VIBRATING SCREENS by Rex Carter and patent application having Ser. No. 13/570,017 filed Aug. 8, 2012, entitled MOBILE MODULAR SCREEN PLANT WITH HORIZONTAL AND VARIABLE OPERATING ANGLES, by Greg Young and Payton Schirm.

The contents of these applications are incorporated herein in their entirety by these references.

BACKGROUND OF THE INVENTION

This invention relates to vibrating screens and more particularly to variably sloped vibrating screens.

The aggregate industry utilizes many styles of screen machines to sort aggregates by size. Most screen machines utilize vibration to agitate the mixture of aggregates to promote separation through various sized openings in the screening surfaces. Sorting is achieved by undersized particles passing through the openings in the screening surface and the oversized particles being retained above the screen surface. These machines usually have some type of vibrating mechanism to shake the unit and its screening surfaces. The vibrating mechanisms usually include an unbalanced weight mounted on one or several rotating shafts which when rotated, force a cycling motion into the screen machine.

Sometimes a screen is designed to be oriented in various sloped positions. This is frequently found in portable equipment that requires a lower profile for travel, as well as multiple sloped positions as needed for various screening applications.

Often material dumped into the feed end of a conveyor will contain a large amount of fine material (sand, dirt, small stones, etc) which will pass very quickly through all of the decks of the vibrating screen. The majority of this material will fall through the first 4 feet to 5 feet length of the screen. Typically, it will fall into the underscreen discharge conveyor, making that an undesirable product. Some prior art systems have used a difficult-to-adjust, conveyor which mounts above the existing underscreen conveyor and is short and extends part way inside the underscreen hopper under the intake end of the screen.

Consequently, there is a need for improvement in sorting systems for variable slope vibrating screens which removes a percentage of fines from the final product.

SUMMARY OF THE INVENTION

More specifically, an object of the invention is to provide an effective vibrating screen for use with input material that has a large amount of fines material.

It is a feature of the present invention to include an underscreen fines pan.

It is an advantage of the present invention to reduce amount of fines material that very quickly passes through all decks and lands upon the discharge conveyor.

It is another feature of the present invention to attach the pan to the underside of the bottom screen.

It is another advantage of the present invention to shake the pan and cause the material thereon to be deflected to either side of the center.

It is still another feature of the present invention to include removable deflecting gates below and to the sides of the underscreen fines pan.

It is still another advantage of the present invention to selectively determine the amount of fines material to be diverted by adding or removing the removable deflecting gates.

It is yet another feature of the present invention to include nested chutes on either side of the screen to carry away the fines material.

It is yet another advantage of the present invention to allow operation of the vibrating screen at variable angles and still permit diversion of the fines material to a fixed location.

The present invention includes the above-described features and achieves the aforementioned objects.

Accordingly, the present invention comprises a vibrating screen with a fines pan attached below the bottom screen, together with removable amount controlling deflecting gates disposed below and to the sides of the fines pan for carrying the fines material into nested chutes.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
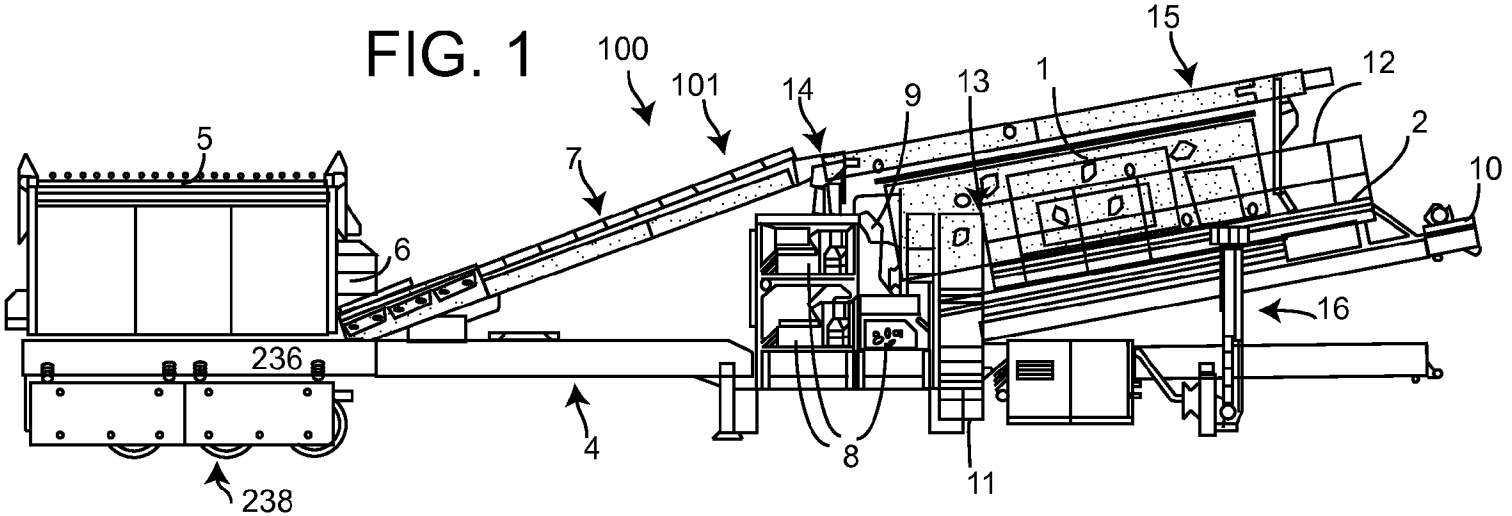
FIG. 1 is an elevation view of a material processing system of the present invention with a screen in an inclined operational configuration.

Now referring to the drawings wherein like numerals refer to like matter throughout, and more specifically referring to FIG. 1, there is shown an elevation view of a material processing system of the present invention, generally designated 100, with a screen 1 in an inclined operational configuration. System 100 includes a feed hopper 5 which may have grizzly bars or other sorting structure thereon to remove oversized objects. Screen 1 is shown disposed on feed hopper frame 236, which is shown supported by feed hopper wheels 238. The material which exits feed hopper 5 is fed up on belt feeder 6 and the bottom feed support section 7 portion of the overhead conveyor 101. A single continuous belt can be supported by bottom feed support section 7, independent intermediate conveyor support section 14 and overhead conveyor head support section 15. Throughout this description, conveyors are discussed as being troughing belt-type conveyors; however, it should be understood that this is an exemplary design, and other systems for conveying material, such as chain conveyors, rollers, augers and any type of system suitable for transporting material could be used. Screen base frame 2 is shown supporting screen 1 and also access walkway railing 12, so that both pivot together when the screen is sloped at an angle for operation. Screen 1, overhead conveyor 101, and feed hopper 5 are all supported by wheeled chassis main frame 4 which also supports, in a "frame fixed" or stationary configuration, cross conveyors 8, blend chute 9 and under screen conveyor 10. A ladder or vertical foot tread structure 11 is coupled to wheeled chassis 4 and not directly to screen base frame 2, which supports access walkway railing 12. It can be seen that steps to railing gap 13 have a variable width dimension when the screen 1 is sloped for operation, by manipulation of hydraulic adjustable support legs 16.

Figure 2:
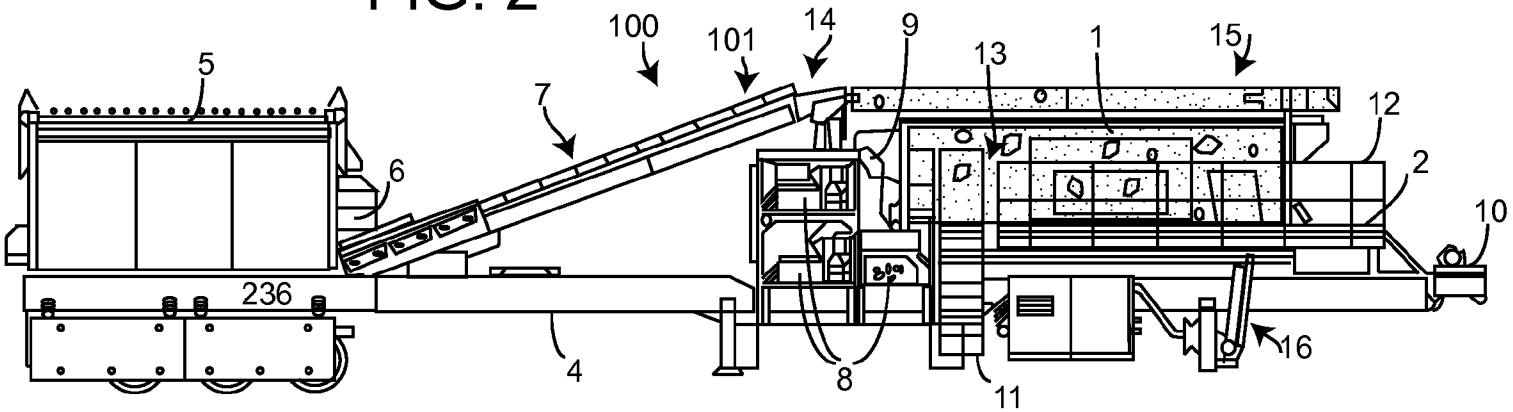
FIG. 2 is an elevation view of the system of FIG. 1 except that the screen is in a horizontal operational configuration.

Now referring to FIG. 2, there is shown the system 100 where the screen 1 is in a horizontal operational configuration. Note that the steps to railing gap 13 remain substantially the same width along vertical foot tread structure 11. Independent intermediate conveyor support section 14 is shown at the same angle as in FIG. 1, but the angle between independent intermediate conveyor support section 14 and overhead conveyor head support section 15 has changed.

Figure 3:
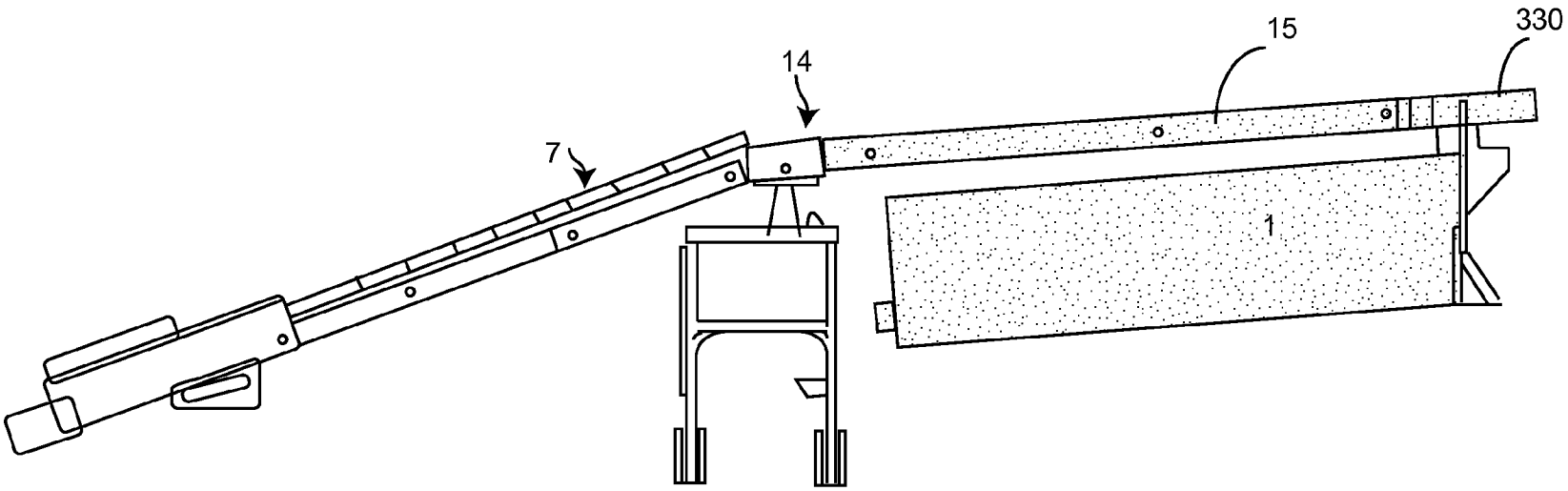
FIG. 3 is a close-up view of a portion of the system of FIGS. 1 and 2 except that the screen is in an intermediate inclined operational configuration.

A more complete understanding of the function and operation of independent intermediate conveyor support section 14 can be gleaned by now referring to FIG. 3, which shows the overhead conveyor head support section 15 oriented at a 5 degree incline (between that of FIGS. 1 and 2.)

Figure 4:
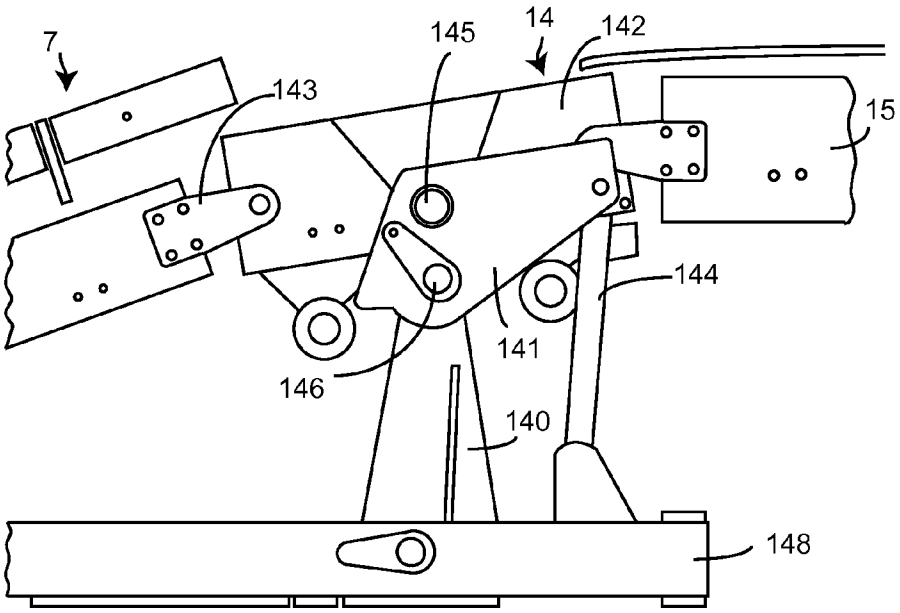
FIG. 4 is a close-up elevation view of an intermediate conveyor support portion of the system and configuration shown in FIG. 2.

Now referring to FIG. 4, there is shown a close-up elevation view of an intermediate conveyor support portion of the system and configuration shown in FIG. 2. The independent intermediate conveyor support section 14 remains at the same angle with respect to the wheeled chassis 4 in all positions of the screen base frame 2. Linkage is shown which maintains this angle, yet allows for relative movement between bottom feed support section 7 and overhead conveyor head support section 15. More specifically, there is shown an intermediate support main leg structure 140 which is pivotally coupled with chassis mounted support 148 and is coupled to intermediate support main linkage body 141 via main leg to main linkage body pivot pin 146. Intermediate support main roller support structure 142 is fixed to intermediate support main linkage body 141 via main roller support to main linkage body connection point 145 and pivotally coupled to bottom feed support section 7 via bottom feed to intermediate support pivotal link 143. Similarly, Intermediate support main roller support structure 142 is coupled to overhead conveyor head support section 15. Pivoting main linkage body to chassis support 144 is pivotally coupled to both intermediate support main linkage body 141 and chassis mounted support 148.

Figure 5:
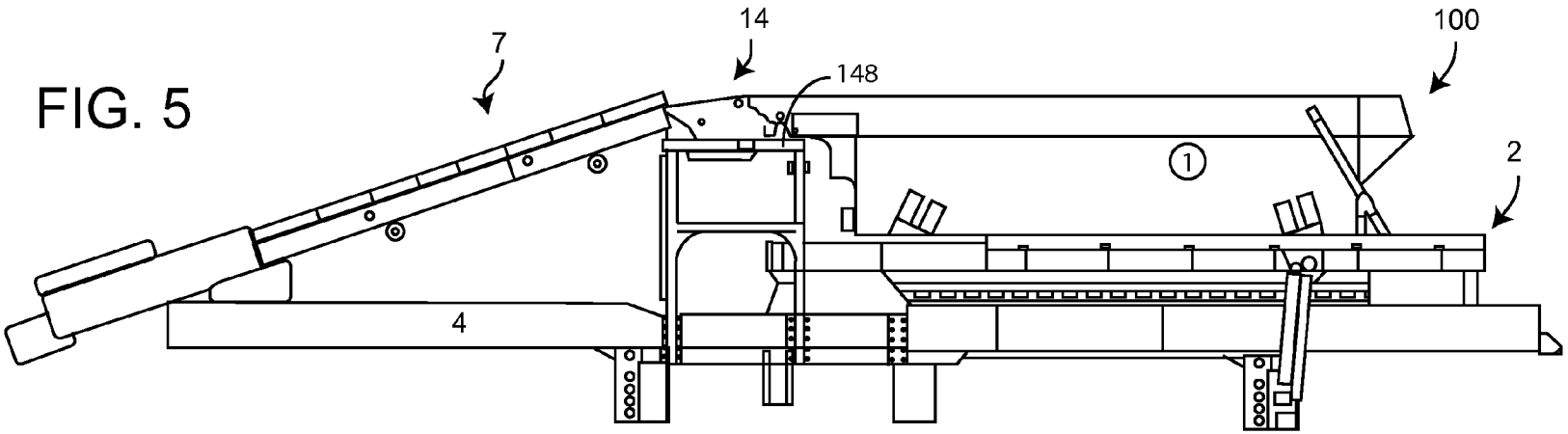
FIG. 5 is an elevation view of the system of FIG. 1 except that the screen is in a horizontal transport configuration.

Now referring to FIG. 5, there is shown an elevation view of the system of FIG. 1, except that the screen is in a horizontal transport configuration.

Figure 6:
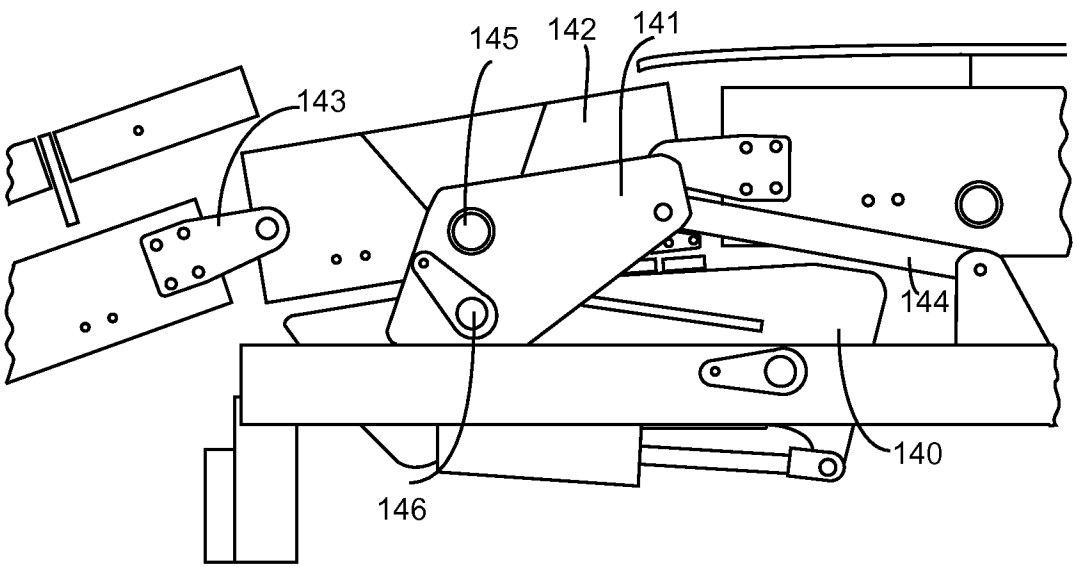
FIG. 6 is a close-up elevation view of an intermediate conveyor support portion of the system and configuration shown in FIG. 5.

Now referring to FIG. 6, there is shown a close-up elevation view of an intermediate conveyor support portion of the system and configuration shown in FIG. 5. In this configuration, the intermediate support main leg structure 140 is substantially horizontal, thereby meaning that the intermediate support main roller support structure 142 is at a lower elevation with respect to the chassis mounted support 148.

Figure 7:
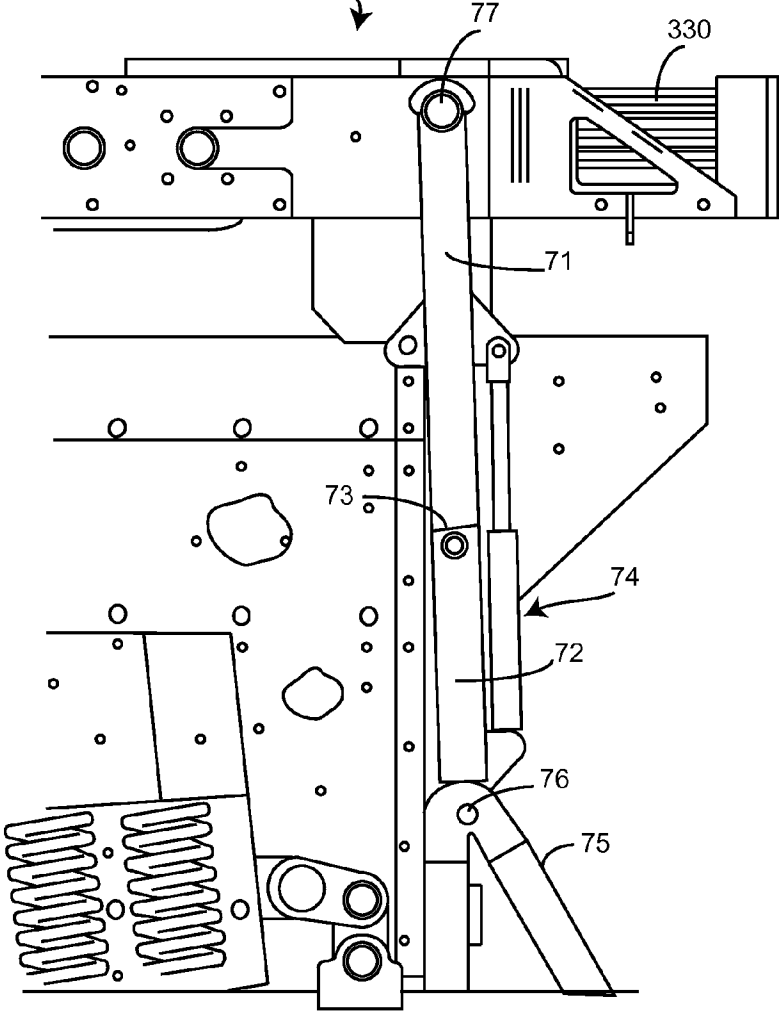
FIG. 7 is a close-up elevation view of a front conveyor support portion of the system and configuration shown in FIG. 2.

Now referring to FIG. 7, there is shown a close-up elevation view of a front conveyor support portion of the system and configuration shown in FIG. 2. Overhead conveyor head support section 15 is held in place by upper slide arm 71 and lower slide arm 72, which are coupled via sliding connection point 73. The length of upper slide arm 71 and lower slide arm 72 is controlled by hydraulic adjustable arm 74, which is coupled at a lower end to lower slide arm 72, which is coupled at pivot point 76 to screen base frame secured support structure 75. Hydraulic adjustable arm 74 is coupled at an upper end to upper slide arm 71, which is coupled to overhead conveyor head support section 15 at conveyor to slide arm pivot point 77. In this horizontal operational configuration, overhead conveyor head support section 15 is directly above, but separated from screen 1.

Figure 8:
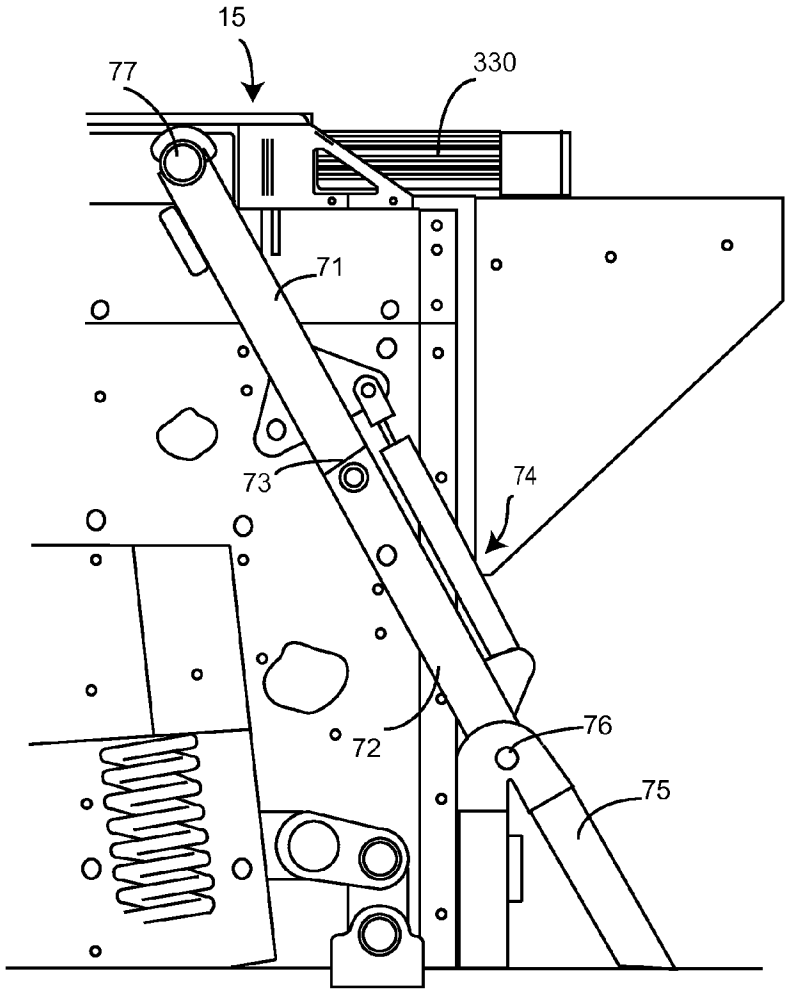
FIG. 8 is a close-up elevation view of a front conveyor support portion of the system and configuration shown in FIG. 5.

Now referring to FIG. 8, there is shown a close-up elevation view of a front conveyor support portion of the system and configuration shown in FIG. 5. Overhead conveyor head support section 15 is clearly shown disposed, at least in part, within a top portion of screen 1.

Figure 9:
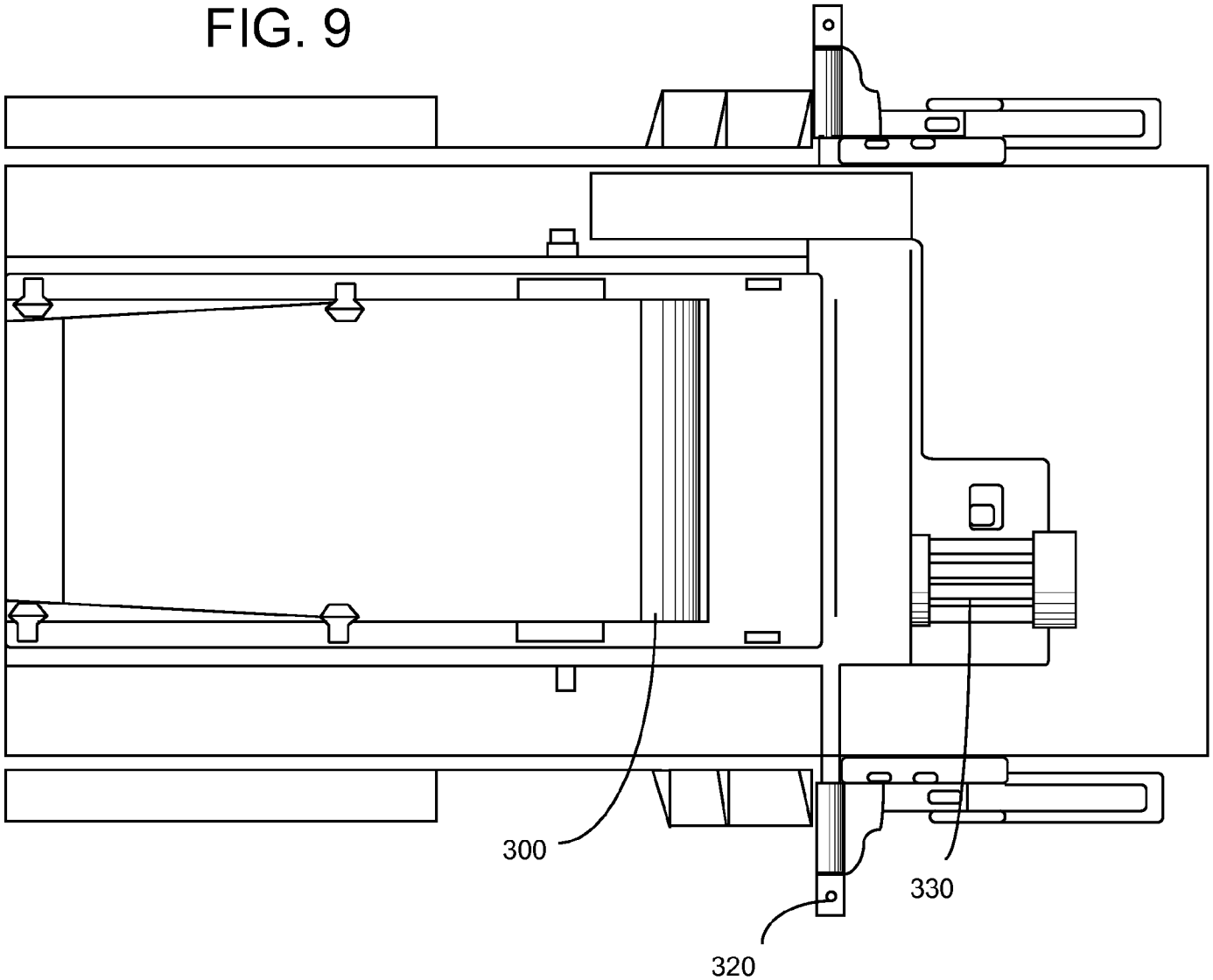
FIG. 9 is a plan view of the top of portions of the system and configuration of FIG. 5.

Now referring to FIG. 9, there is shown a plan view of the top of portions of the system and configuration of FIG. 5.

Figure 10:
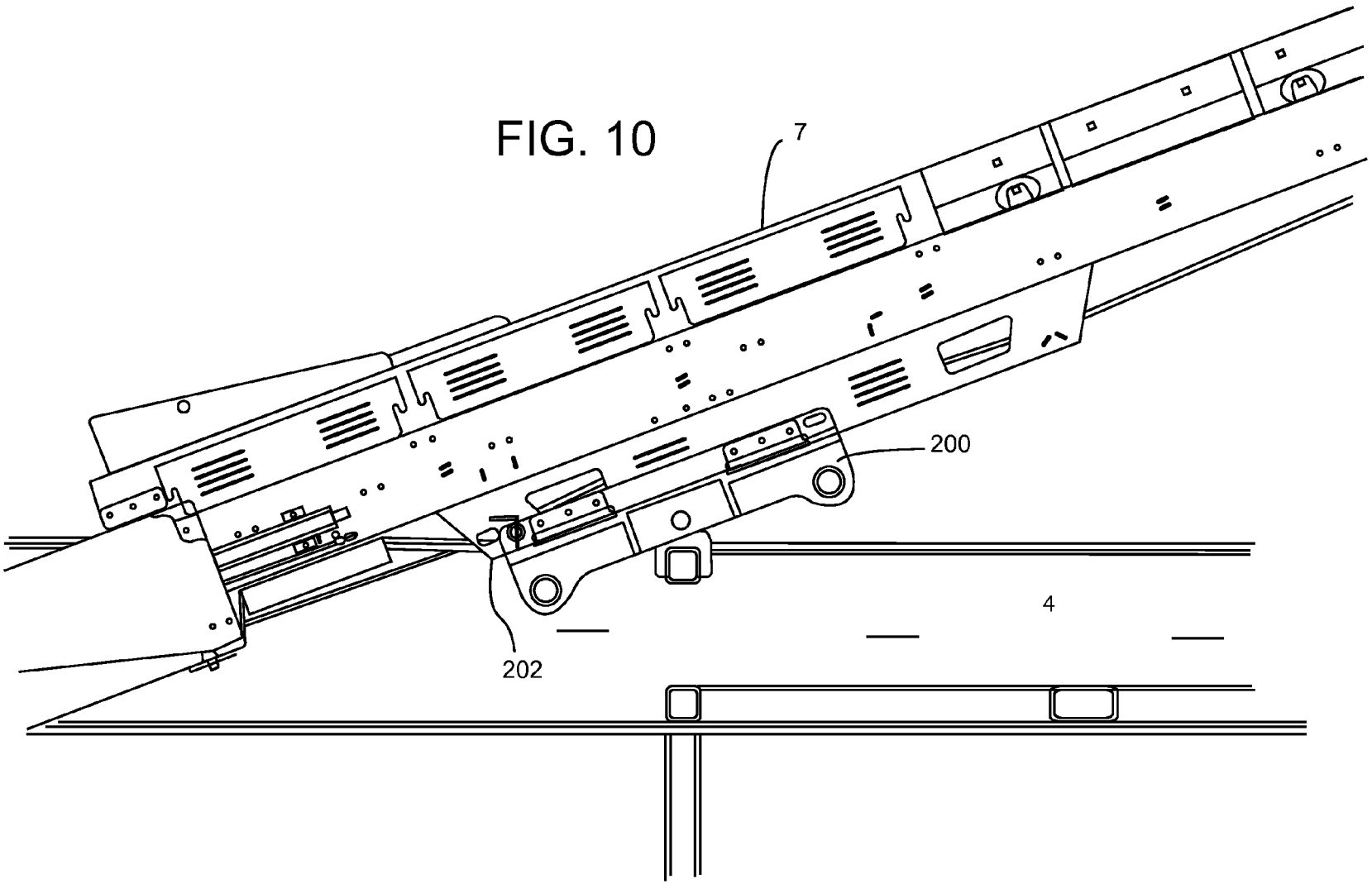
FIG. 10 is a close-up elevation view of a tail section slide/pivot support portion of the system and configuration shown in FIG. 2.

Now referring to FIG. 10, which shows a close-up elevation view of a tail section slide/pivot support portion of the system and configuration shown in FIG. 2, the bracket 200 is fixed to the wheeled chassis 4 while the fixed location 202 is fixed to the bottom feed support section 7 as it translates along its path.

Figure 11:
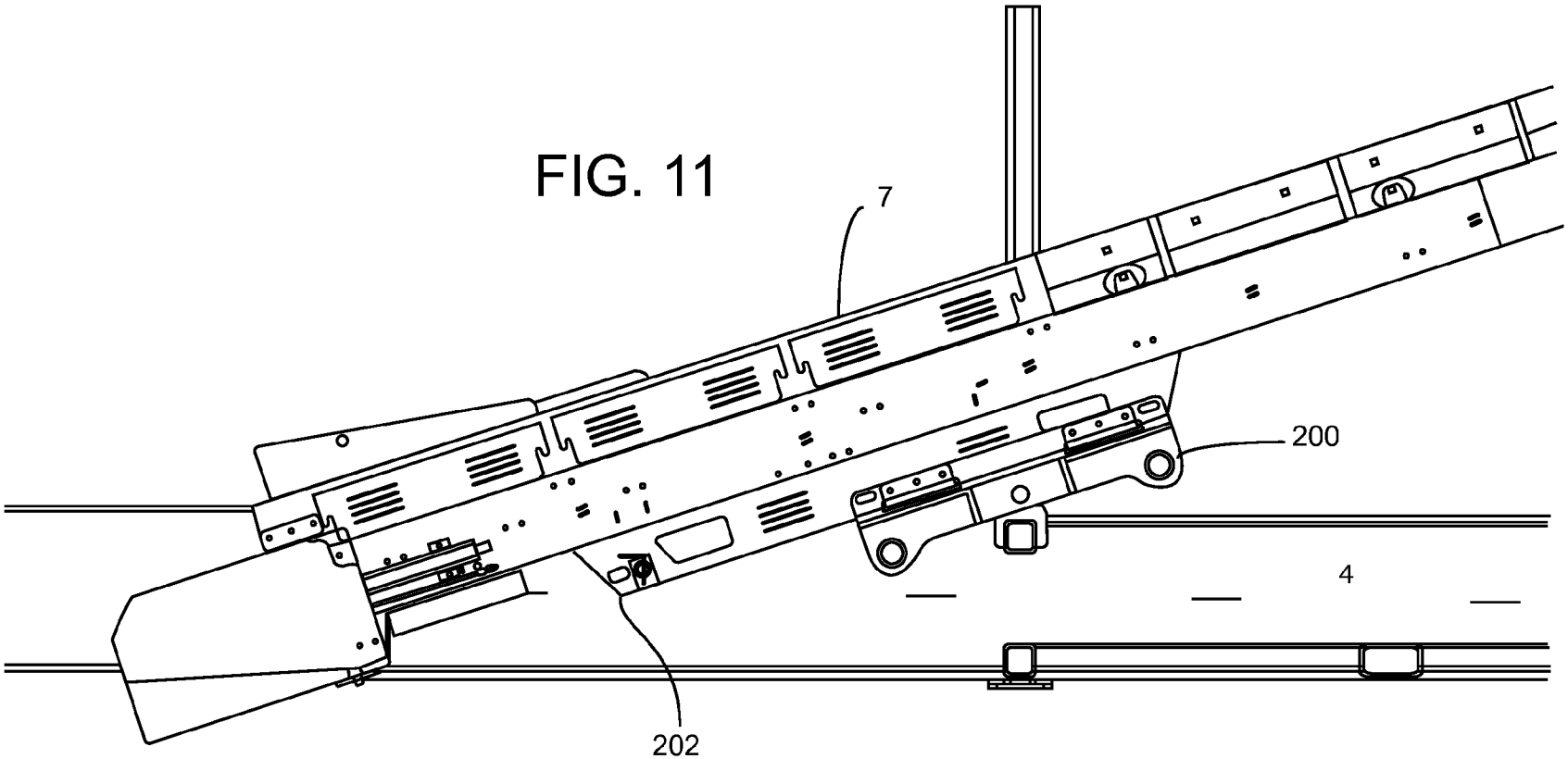
FIG. 11 is a close-up elevation view of a tail section slide/pivot support portion of the system and configuration shown in FIG. 5.

FIG. 11 is a close-up elevation view of a tail section slide/pivot support portion of the system and configuration shown in FIG. 5. Note that fixed location 202 is outside of the bracket 200.

Figure 12:
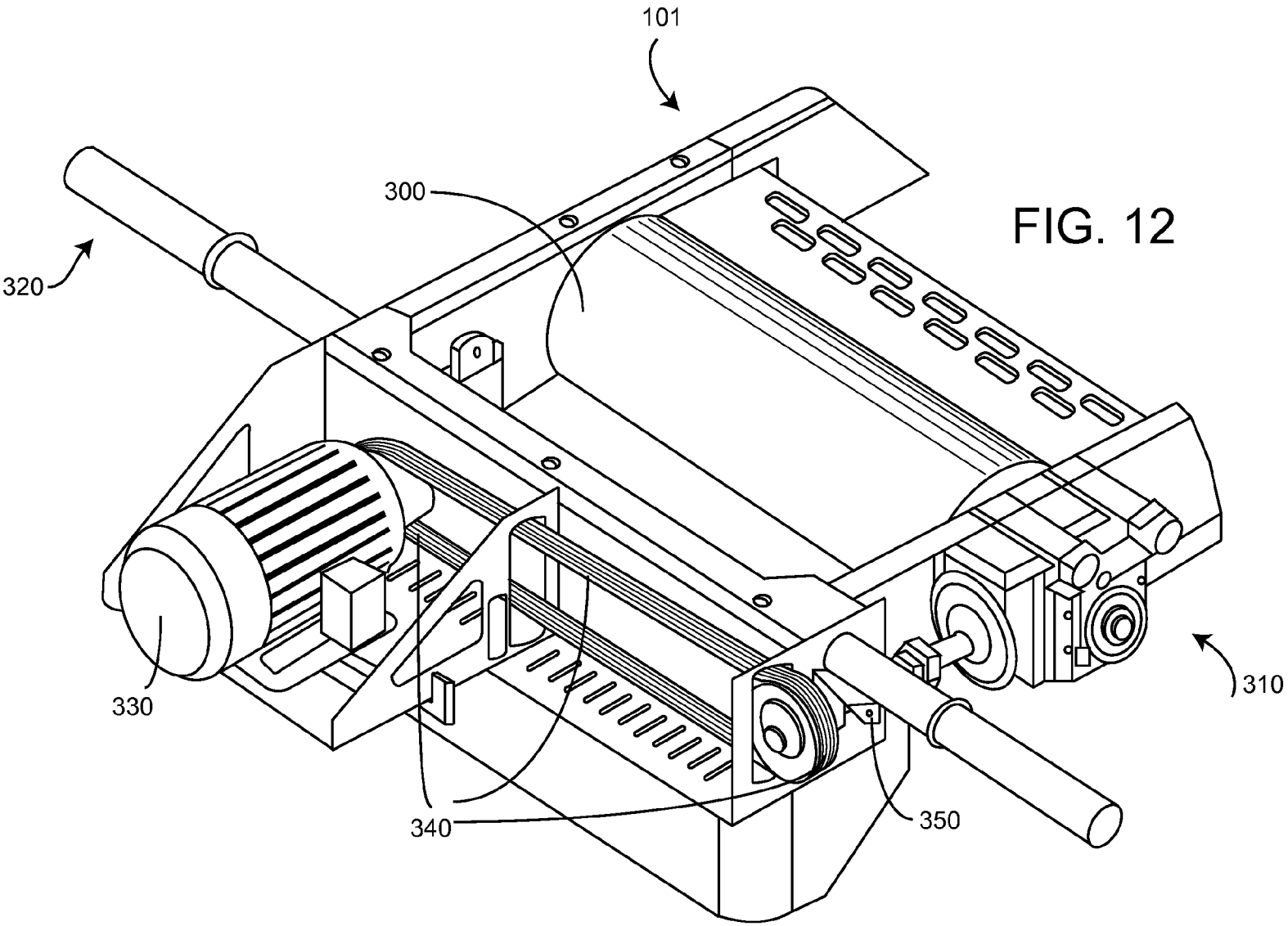
FIG. 12 is a close-up, partially dismantled view of the conveyor 15 of FIG. 9.

Now referring to FIG. 12, there is shown a close-up view of a portion of the overhead conveyor 101, which includes a head pulley 300 to cooperate with the conveyor belt (not shown) to move the conveyor belt and thereby transport material for processing. Head pulley 300 is driven through a speed reducer 310, which may be a 90-degree speed reducing gear assembly which is coupled to a jack shaft 350, which is coupled to v-belt drive 340 which is powered by motor 330. Speed reducer 310 is preferably an input shaft-type speed reducer which is flange or face mounted to the conveyor frame and is shorter in width (along the turning axis of head pulley 300) than the motor 330. The above system is supported at least in part by support structure 320, which may be disposed at side mount pivot point 77. Motor 330 may be a single speed motor, and speed of the rotation of the head pulley 300 can be changed by changing the size of sheaves on the motor 330 and jack shaft 350. The length of the jack shaft 350 may be varied; i.e., replaced with a longer jack shaft if high speed operation is expected and, therefore, the trajectory of material of the head pulley 300 would be flatter and further. The width of the overhead conveyor 101 is reduced because the width of the head pulley 300 and speed reducer 310 combined is less than what it would have been had the motor been mounted next to the speed reducer 310 in the present invention, so its central axis is parallel to the turning axis of the conveyor head pulley.

Figure 13:
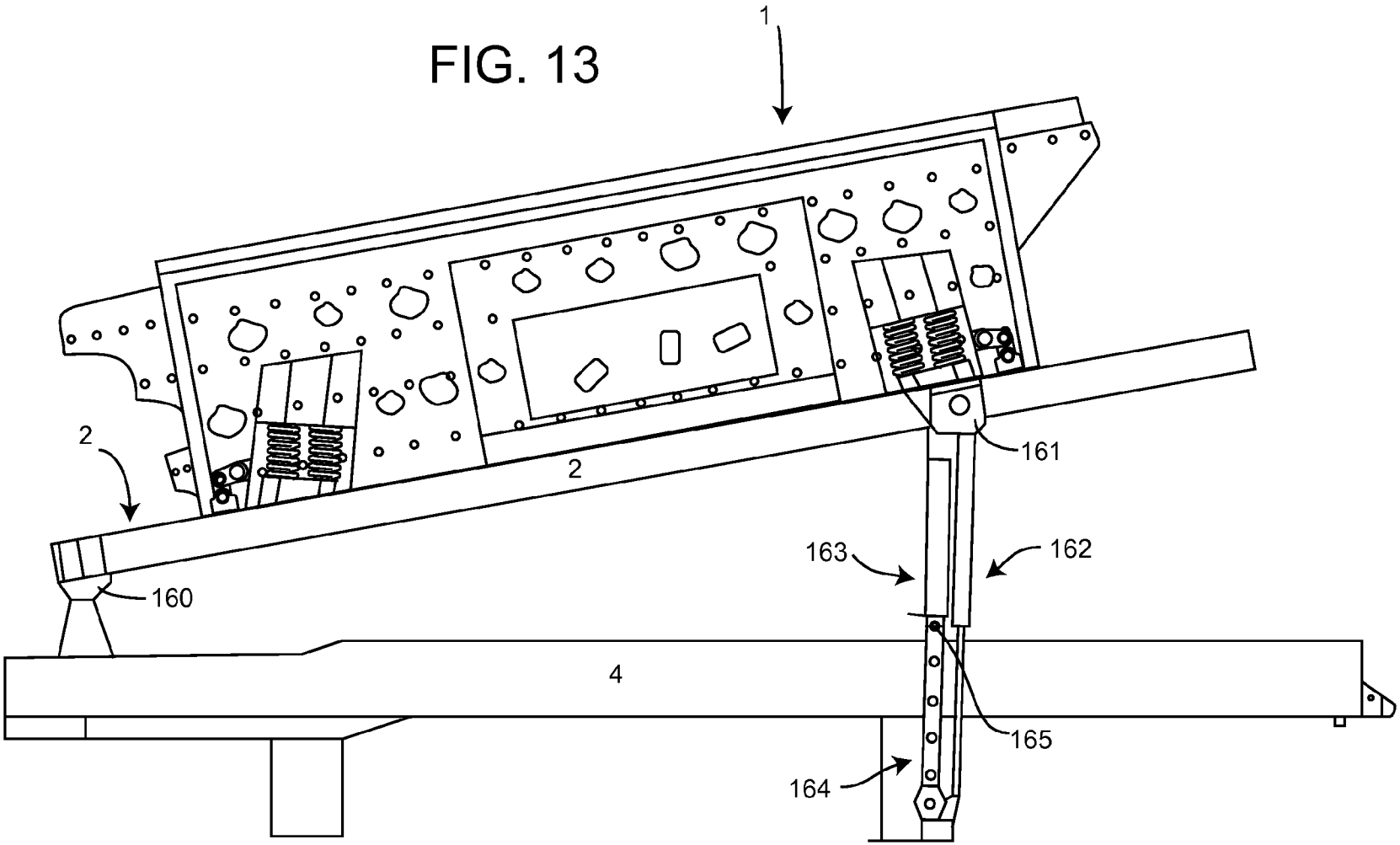
FIG. 13 is a close-up view of portions of the screen of FIG. 1.

Now referring to FIG. 13, there is shown screen 1 raised to an inclined operation position by hydraulic adjustable support legs 16, which comprise a cylinder 162 for providing lifting force and an outer adjustable support leg 163 and an inner adjustable support leg 164 which can be locked to a predetermined length by locking pin 165. The screen is coupled to hydraulic adjustable support legs 16 at lifting point 161 and is pivoted about base frame pivoting point 160. In operation, once the locking pin 165 is inserted, the cylinder 162 is commanded to pull down upon the locking pin 165, thereby removing any slack in the system that can result in unwanted vibration of the support structure. Alternatively, a threaded rod, ball screw or other tensioning device could be used to remove slack.

Figure 14:
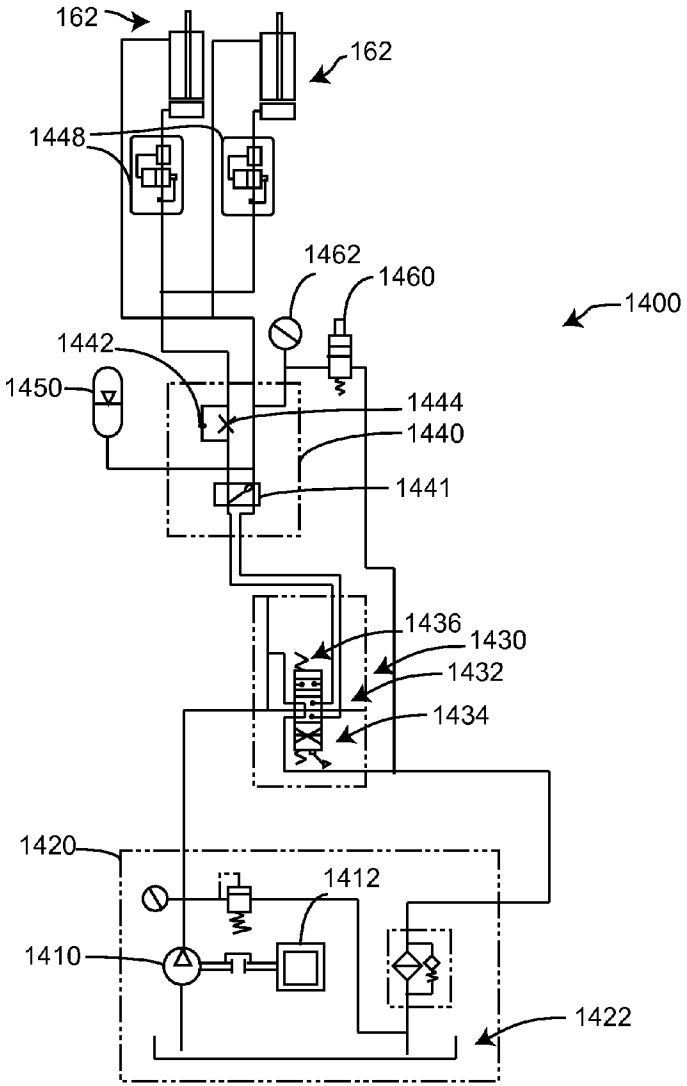
FIG. 14 is a schematic diagram of a hydraulic circuit of the present invention.

Now referring to FIG. 14, there is shown a hydraulic circuit, generally designated 1400. Generally, the system controls the operation of hydraulic adjustable support legs 16 via cylinder 162 by controlling hydraulic pressure thereto. The system performs two main functions: 1) lifting and lowering the screen 1 to angled orientations and 2) reducing the slack or slope in the mechanism holding or applying a biasing force to urge the screen in such positions. Hydraulic pressure power unit 1420 includes a hydraulic pump 1410 and a tank 1422 for providing high pressure hydraulic fluid to the cylinder 162. Hydraulic pump 1410 is coupled to system control valve 1430, which may be a 3 position valve with a system control valve return to tank normal position 1432, a system control valve return criss-cross flow position 1434 and a system control valve return up down position 1436, depending on the direction the valve is slid. Two lines (A and B) exit system control valve 1430 and go to cylinder 162. Note the cylinder 162 has a port for applying pressure to retract and another for extending. The lines into each of these ports are capable of providing fluid into and receiving fluid from the cylinder 162. Lines A and B enter manifold 1440 and encounter manifold pilot operated check valve 1441. Check valve 1441 allows free-flow of oil into cylinder 162, but flow control valve 1444 meters oil out of cylinder 162.

When the screen 1 is operating and the system 1400 is attempting to minimize slack in the support system, Pilot open check valve 1441 holds pressure in the retract side of cylinder 162. The accumulator 1450 stores the pressure in the system. Accumulator 1450 provides for this holding pressure to continue at a functional level longer and thereby reduce the frequency that the system will need to be re-pressurized to function optimally. A pressure gauge 1462 is provided so a worker can re-pressurize the accumulator when necessary. Alternately, this could be automated with a sensor and transducer loop etc. Flow fuses 1448 are included to minimize losses in the event of a sudden failure (e.g., a burst hose etc.). A dump valve 1460 is included for use during maintenance or other times when completely discharging the pressure in the system 1400 is desired.

Figure 15:
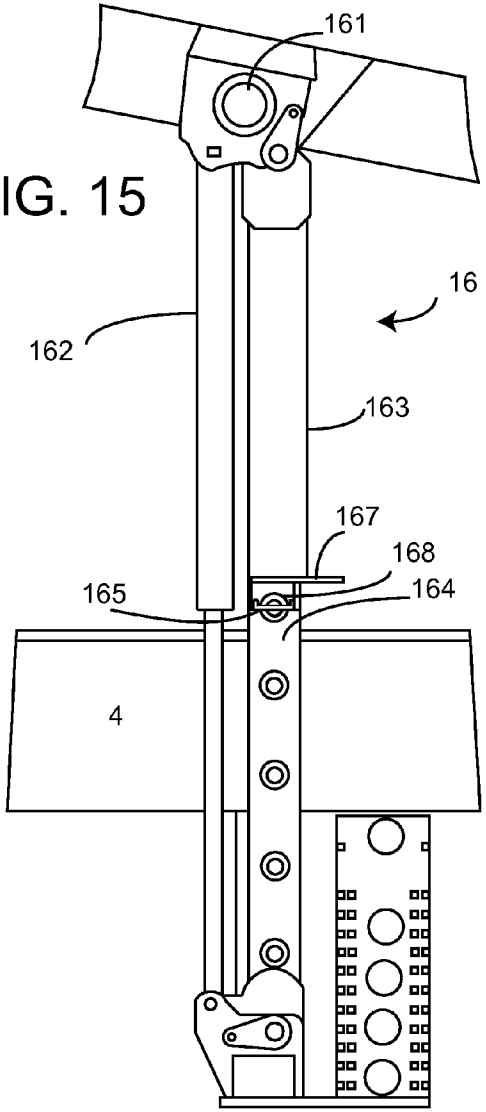
FIG. 15 is a close-up view of a portion of the screen of FIG. 13.

Now referring to FIG. 15, there is shown a close-up view of the hydraulic adjustable support legs 16 of the present invention, which includes cylinder 162 outer adjustable support leg 163, inner adjustable support leg 164, locking pin 165 and half circle void 168 in outer adjustable support leg 163 so as to receive locking pin 165. A pin storage bracket 167 is shown disposed adjacent to the half circle void 168 and is used to hold locking pin 165 when not inserted through the holes.

Figure 16:
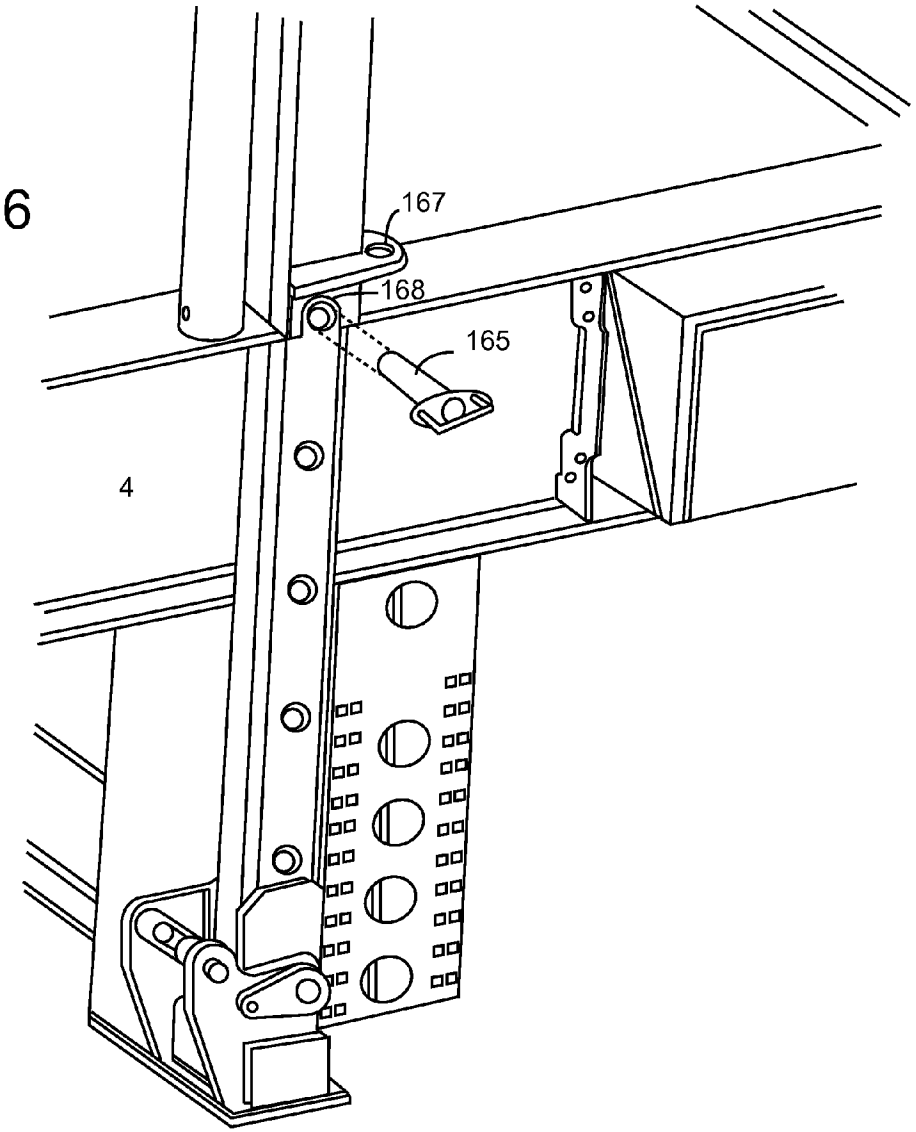
FIG. 16 is a very close-up partially exploded view of a portion of the assembly of FIG. 15.

Now referring to FIG. 16, there is shown a closer partially exploded view of outer adjustable support leg 163, inner adjustable support leg 164 and locking pin 165 combination of the present invention.

Figure 17:
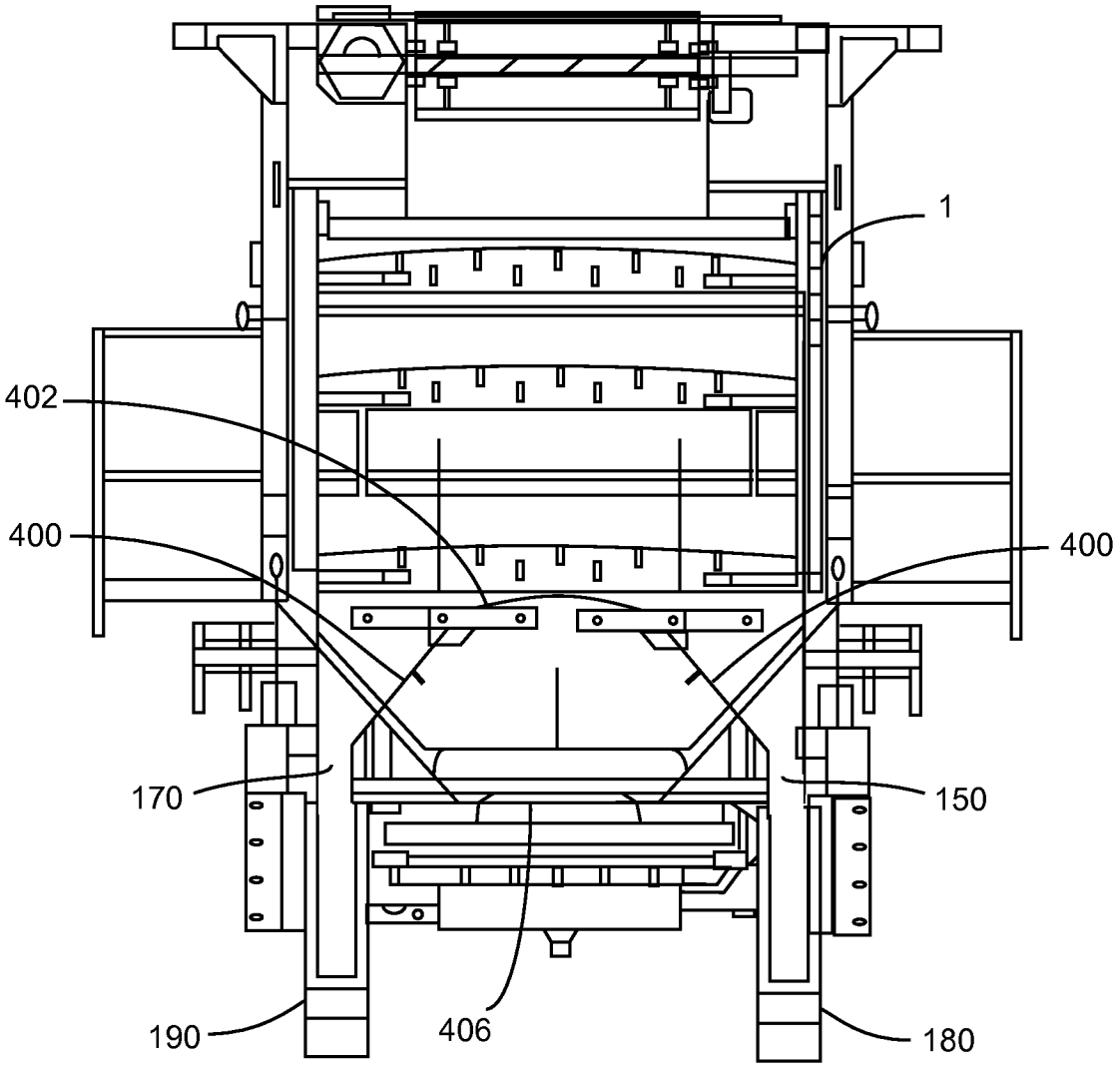
FIG. 17 is an end view of the screen of FIG. 1.

Now referring to FIG. 17, there is shown an end view of the screen 1 with an innovative fines scalping feature of the present invention. The system functions as follows: fines drop below the bottom screen deck onto underscreen fines pan 402, which carries the fines material to an area where they can be deflected into right-hand fines primary movable chute 150 and left-hand fines primary movable chute 170 or alternately passed down to underscreen discharge reject conveyor 406. Right-hand fines primary movable chute 150 and left-hand fines primary movable chute 170 are connected to the screen and are tilted up and down as the screen 1 is moved between various angular operating, transport and/or maintenance positions. Right-hand fines primary movable chute 150 mates with right-hand fines secondary fixed chute 180, which is fixed to the frame of the system (which does not pivot). Similarly, left-hand fines primary movable chute 170 mates with left-hand fines secondary fixed chute 190.

Figure 18:
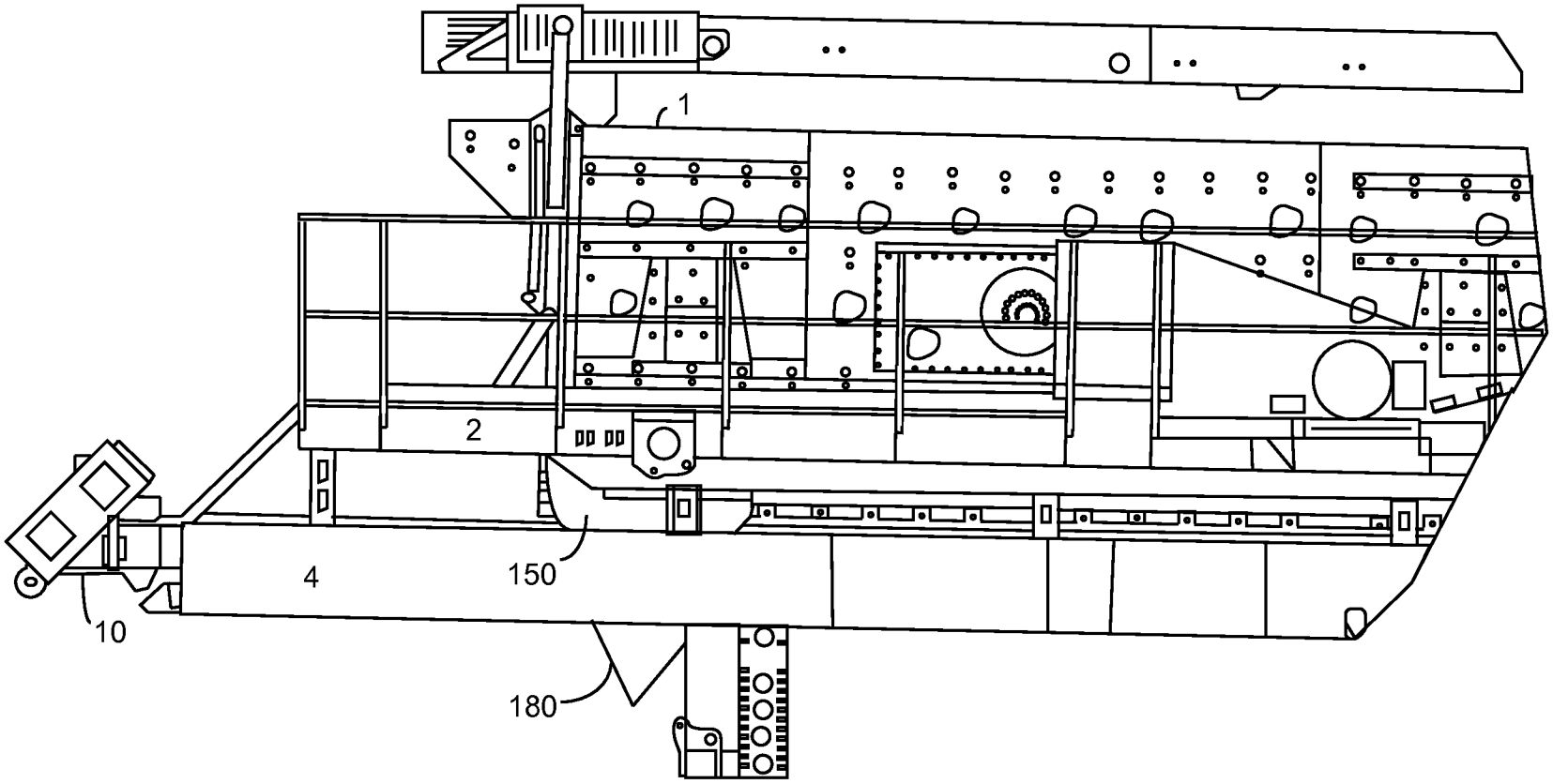
FIG. 18 is a close-up view of portions of the screen of FIG. 1.

Now referring to FIG. 18, there is shown a side view of the screen 1 in a horizontal (non-angled) position. The chutes are visible.

Figure 19:
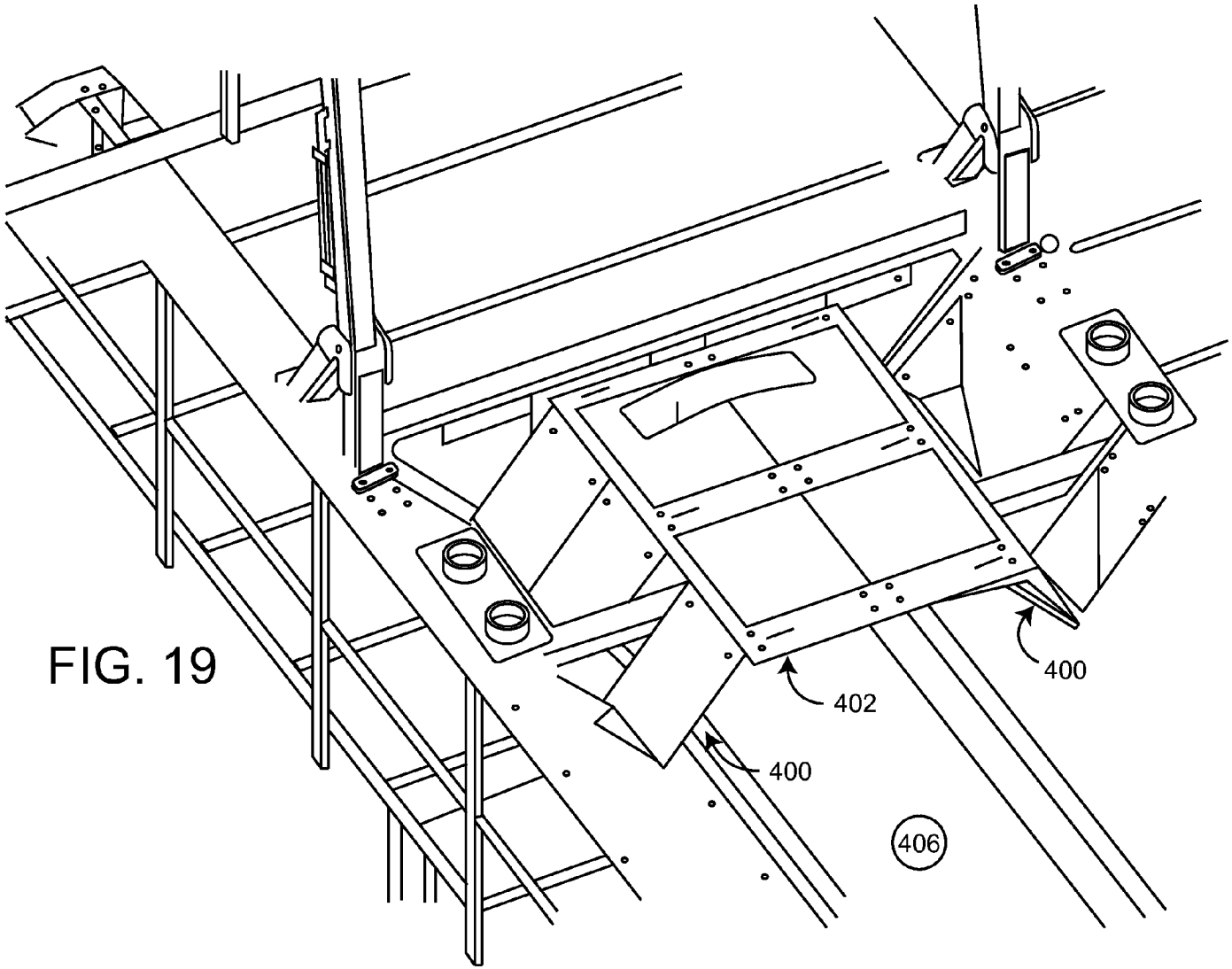
FIG. 19 is a close-up partially dismantled view exposing portions of the gates of the screen of FIG. 1.

Now referring to FIG. 19, there is shown a partially dismantled screen of the present invention which exposes to view the underscreen fines pan 402, adjustable deflecting gates 400 and underscreen discharge reject conveyor 406 and their respective orientations.

Figure 20:
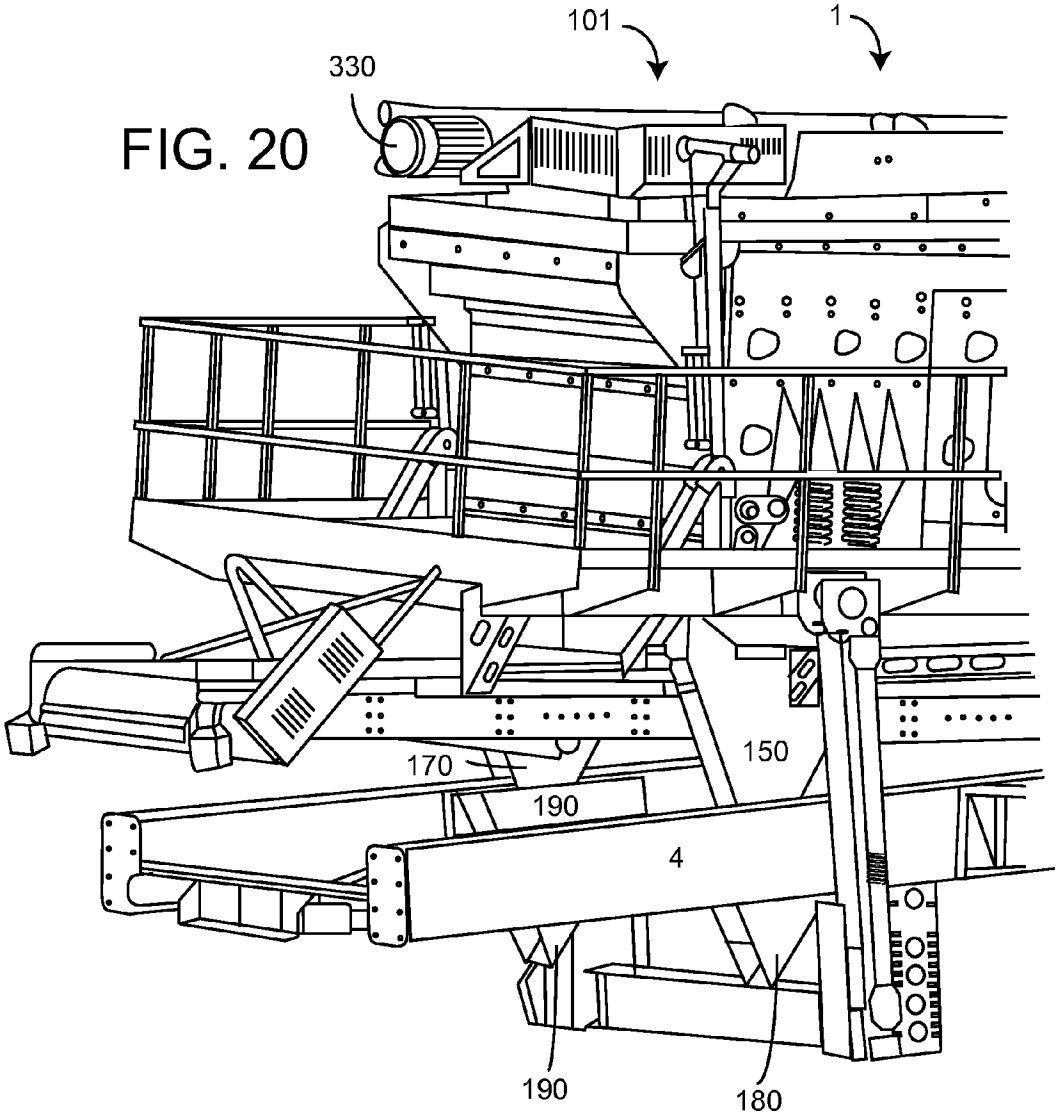
FIG. 20 is a close-up view of a portion of the chutes of the screen of FIG. 1.

Now referring to FIG. 20, there is shown a perspective view of the system of the present invention where nesting relationship of left-hand fines primary movable chute 170 and left-hand fines secondary fixed chute 190 is clearly shown.

Figure 21:
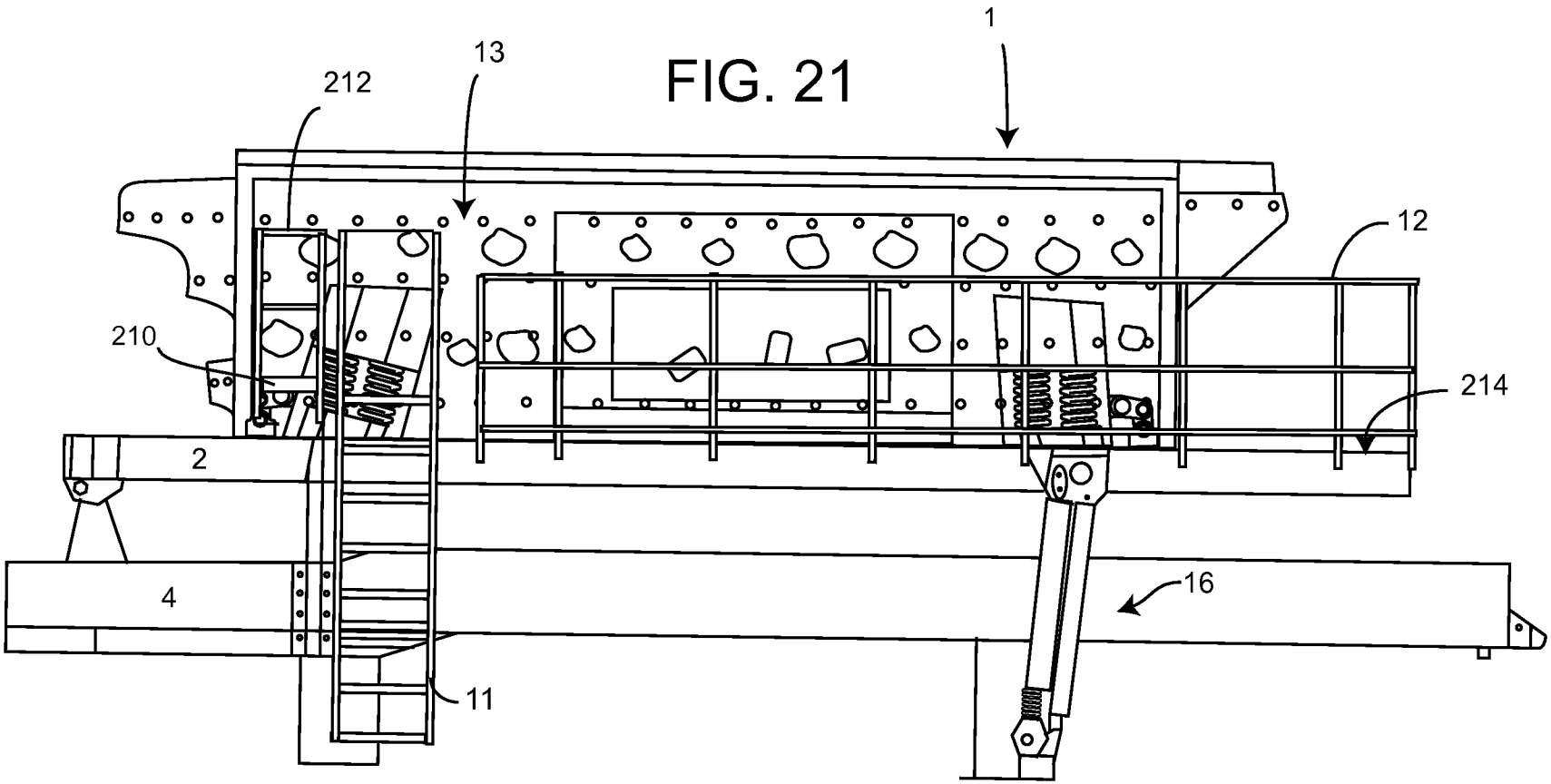
FIG. 21 is a side view of the screen of the present invention.
Figure 22:
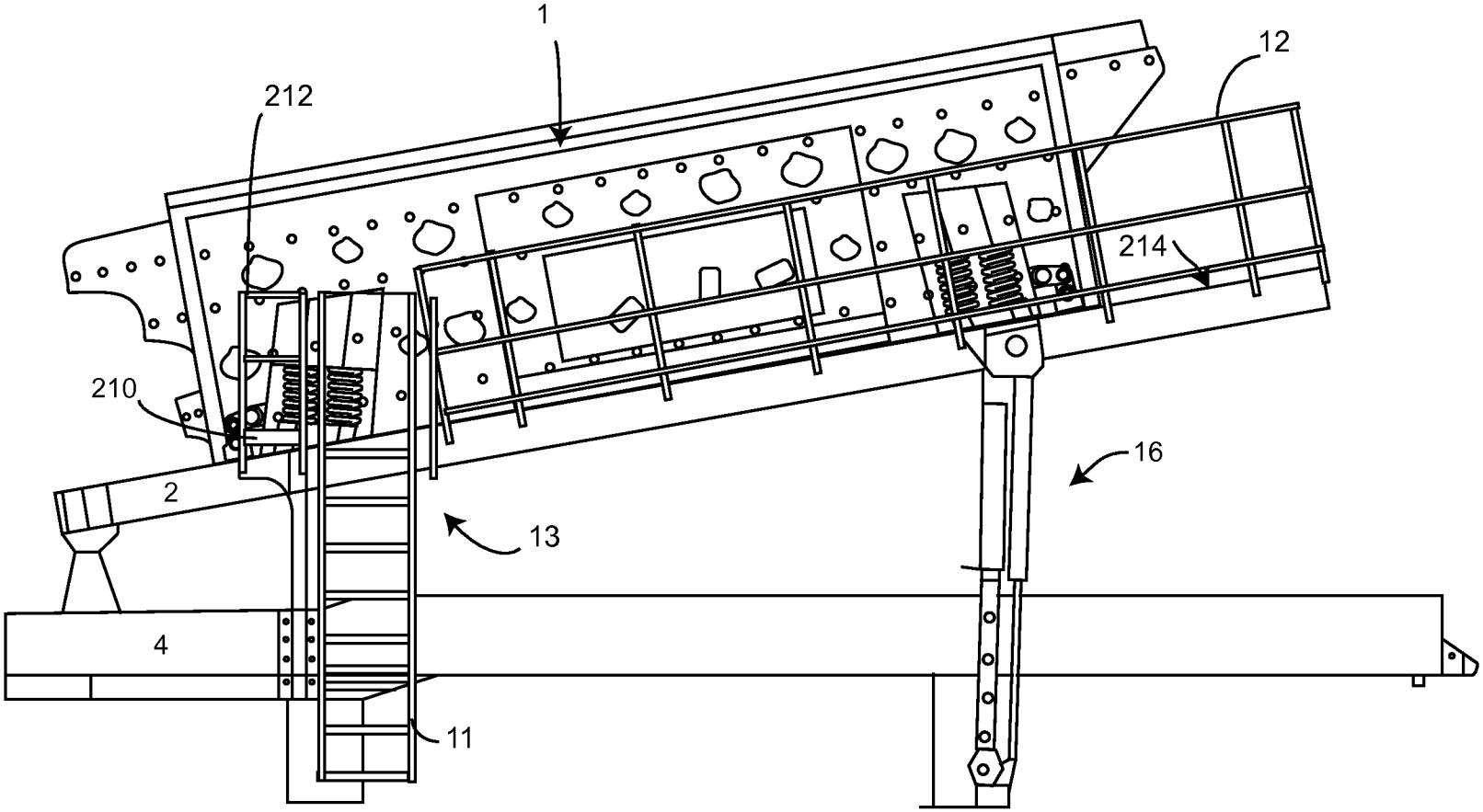
FIG. 22 is a side view of the screen of FIG. 21, but in sloped screen configuration.

Now referring to FIG. 21, there is shown a side view of the screen 1 of the present invention in a horizontal configuration, the gap 13 between stationary access platform railing 212 and railing 12 is shown at a maximum. Note that the stationary access platform railing 212 is fixed to the wheeled chassis main frame 4 as is the ladder 11. As the screen 1 pivots to various operating angles, the stationary access platform railing 212 and ladder 11 remain stationary; i.e., fixed to the frame 4. When the screen is in a horizontal configuration, the stationary access platform railing 212 and the pivoting access platform 214 may be flush; i.e., no step up required. When the screen is pivoted upwardly as is shown in FIG. 22, the stationary access platform railing 212 is stationary, and the nearest portion of the pivoting access platform 214 has been relatively elevated, thereby requiring a person to step up from the stationary access platform 210 to the pivoting access platform 214. However, as they walk along pivoting access platform 214, the railing 12 is at a constant height. In another configuration, there may be a required step down when the screen is in a horizontal configuration; and at a midpoint between horizontal and maximum inclination, no step up or down would be required and when the screen is at a maximum inclination, there would be a required step up. This level at the middle angle of inclination approach minimizes the magnitude of the highest step up or down required over the range of inclination angles. This configuration is shown in FIGS. 22 and 23.

Figure 23:
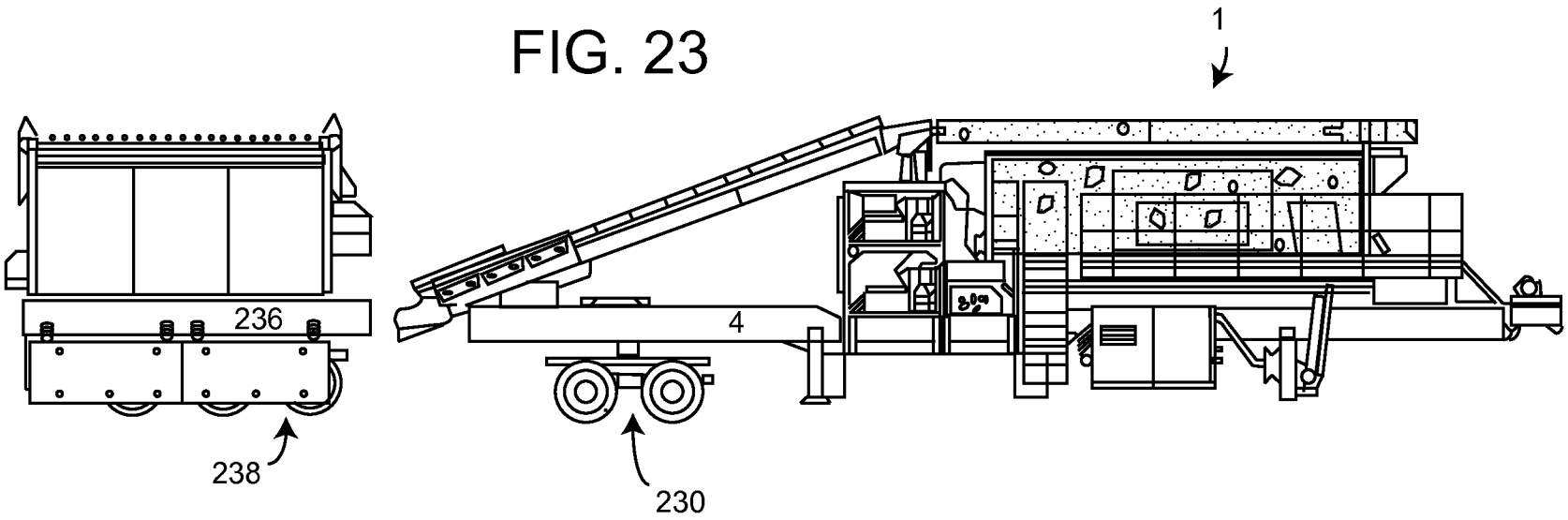
FIG. 23 is a view of the present invention in a detached modular configuration.

Now referring to FIG. 23, there is shown an alternate configuration of the system of FIGS. 1 and 2, where the wheels 238 are attached to a feed hopper frame 236 which is detached from the wheeled chassis main frame 4, which is now shown with wheels 230 attached thereto. This approach can permit use of the system without the feed hopper 5, or it can permit separate towing of the feed hopper 5 from the remainder of the system.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A mobile variable slope vibrating screen system for material processing comprising:

a vibrating screen, comprising a plurality of stacked screens of differing material size openings;

a fines pan coupled to and disposed underneath a bottom screen in said plurality of stacked screens;

a fines primary movable chute coupled to and being incline adjustable in concert with said vibrating screen;

a fines secondary fixed chute configured to receive material exiting said fines primary movable chute;

an underscreen discharge reject conveyor disposed below and receiving material passing through said bottom screen;

a central region disposed beneath a central portion of the bottom screen at a top end of the vibrating screen; and means for separating material which is incident upon the central region;

wherein said means for separating comprises a plurality of downwardly and outwardly angled deflecting gates which are removable and repositionable for the purpose of regulating an amount of fines material that is diverted away from dropping onto the underscreen discharge reject conveyor.

2. The screen of claim 1 wherein said fines primary movable chute comprises a right side fines primary movable chute and a left side fines primary movable chute.

3. The screen of claim 2 wherein:

said vibrating screen is a variable slope vibrating screen; and said fines secondary fixed chute further comprises:

a right side fines secondary fixed chute disposed beneath the right side fines primary movable chute and a left side fines secondary fixed chute disposed beneath the left side fines primary movable chute.

4. A variable slope vibrating screen system comprising:

a plurality of stacked screens;

means for angularly adjusting an inclination angle of said plurality of stacked screens;

an underscreen discharge reject conveyor;

means for regulating an amount of fines material being diverted away from dropping onto said underscreen discharge reject conveyor;

a means for discharging fines material at a fixed location despite variable angles of inclination of said plurality of stacked screens;

a fines pan, and a plurality of removable deflecting gates;

wherein said fines pan is attached beneath and configured to shake with a bottom screen of said plurality of stacked screens; and wherein said plurality of deflecting gates can be extended further downward along the length of the bottom screen to control an amount of fines material that is deflected from the top portion of the bottom screen.

5. The screen system of claim 4 wherein said means for regulating comprises:

a fines pan, and a plurality of removable deflecting gates.

6. The screen system of claim 4 wherein said means for discharging fines material at a fixed location comprises:

a movable chute partially nested within a stationary chute.

* * * * *